US005186912A

United States Patent [19]

Steindorf et al.

[11] Patent Number: 5,186,912

[45] Date of Patent: Feb. 16, 1993

[54] CONTROLLED RELEASE DISHWASHER DETERGENT DISPENSER

[75] Inventors: Richard E. Steindorf, St. Paul, Minn.; Katsumi Maeda, Tokyo, Japan; Daniel K. Boche, Eagan, Minn.; Yoichi Satoh, Kanagawa, Japan

[73] Assignee: Ecolab, Inc., St. Paul, Minn.

[21] Appl. No.: 637,054

[22] Filed: Jan. 3, 1991

[51] Int. Cl.[5] ..... B01F 1/00; C11D 17/00

[52] U.S. Cl. ..... 422/263; 422/264; 422/266; 422/276; 137/268; 252/90

[58] Field of Search ..... 422/263, 264, 264 B, 422/266, 274, 275, 276; 134/93; 252/90; 137/268; 222/651; 68/17 R

[56] References Cited

U.S. PATENT DOCUMENTS

| | | | |
|---|---|---|---|
| 3,595,786 | 7/1971 | Horvath et al. | 422/264 B |
| 4,261,957 | 4/1981 | Schimanski | 422/263 |
| 4,350,666 | 9/1982 | Klutts | 422/264 |
| 4,545,917 | 10/1985 | Smith et al. | 137/268 X |
| 4,555,819 | 12/1985 | Weiss et al. | 422/263 X |
| 4,569,780 | 2/1986 | Fernholz et al. | 252/90 |
| 4,569,781 | 2/1986 | Fernholz et al. | 252/92 |
| 4,630,634 | 12/1986 | Sasaki et al. | 137/268 |
| 4,759,907 | 7/1988 | Kawolics et al. | 422/264 X |
| 4,777,670 | 10/1988 | Klinkhammer et al. | 422/263 X |
| 4,808,236 | 2/1989 | Davis | 134/25.2 |
| 4,813,084 | 3/1989 | Buecheler et al. | 422/266 X |

*Primary Examiner*—Robert J. Warden
*Assistant Examiner*—Stephanie Blythe
*Attorney, Agent, or Firm*—Merchant, Gould, Smith, Edell, Welter & Schmidt

[57] ABSTRACT

A dispenser (10) and method for washing dishes and utensils in a dishwashing machine are disclosed. The dispenser (10) is comprised of a container (11) and lid (12), the dispenser containing a solid detergent composition (13). A slot (23) in a side wall (17) and baffle (26) allow for controlled drainage of the detergent solution. The lid (12) has a plurality of openings (18) through which water from the dishwashing machine enters, so as to dissolve the solid detergent (13). The dispenser (10) is positioned within the washing chamber (20) of a dishwashing machine (19).

13 Claims, 3 Drawing Sheets

CONTROLLED RELEASE DISHWASHER DETERGENT DISPENSER

FIELD OF THE INVENTION

The invention relates generally to a dispenser for use with dishwashing machines and more particularly to a dispenser containing a solid detergent product which is disposable after multiple dishwashing cycles.

BACKGROUND OF THE INVENTION

Food processing, preparation, serving and consumption produces large quantities of reusable soiled dishes, table ware, pots and pans, and other equipment often referred to as utensils. Before such items can be reused, they must be washed and usually dried. Industrial and institutional cleaning of such goods is generally done in machine washing equipment of various types. Essentially all washing machines employ an aqueous detergent solution to clean the soiled dishes and other food handling equipment. The aqueous detergent solution is generally sprayed onto the soiled items in an enclosed chamber so that both the solubilizing action of the solution and the mechanical action of the spray against the items combine to clean the soiled dishes and the like.

Restaurants and institutions already have available several types of detergent products for use in dishwashing machines, including granular compositions, liquids, and solid bricks or blocks. Some of these are directly introduced into the machine; these in-machine dispensers are particularly useful with relatively small machines. In other cases, particularly for large commercial machines, the detergent is dispensed automatically by various types of feeding equipment. However, the latter dispensers are expensive, especially in regard to production and maintenance.

More recently, block-formed detergents for domestic and institutional dishwashing machines have been developed, which have the advantage of being dimensionally stable. These detergents are dissolved by simply spraying with water, and then are delivered to the wash machine in solution. Since institutional detergents often have a high caustic alkali content, contact with the skin should be avoided. Block-formed detergents are much safer to handle and thus also superior in this regard.

One type of automatic equipment for producing a detergent washing solution from a solid cast detergent block is disclosed in Fernholz et al, U.S. Pat. No. 4,569,781. U.S. Pat. Nos. 4,569,780 and 4,569,781 describe a detergent container suitable for use in automatic detergent dispensers adapted for dispensing detergents in block form. A molten detergent is poured into the container and allowed to solidify. The detergent is subsequently dissolved from the container on contact with a stream of fresh service water. The advantage of a block-form detergent and dispenser combination of this type is that, with proper handling, contact with the skin is virtually eliminated. However, this type of dispenser is external to the dishwashing machine and requires plumbing connectors and in some configurations, electrical connections in order to be operational.

A dispenser which is internal to the dishwashing machine is disclosed in U.S. Pat. No. 4,808,236, issued to Davis. The Davis dispenser has a cup-like container which holds a detergent block suitable for dispensing in a dishwashing machine. The container has a removable lid with a tab which covers an opening in the container's top. The Davis dispenser is placed on the dishwasher's scrap tray with a firm tap to cause the detergent block to drop down and rest on the scrap tray. When the lid and tab are removed, the machine's washing water enters the opening in the container top and flows downwardly along the side of the detergent block, thereby forming a detergent solution. The detergent solution flows out of the container's open mouth bottom.

The Davis container, however, has several drawbacks. First, the detergent block is used up quite quickly, so that the user must frequently remove the container from the dishwashing machine and substitute a new detergent block. In addition, the concentration of the detergent solution for most of the block's life is excessively high, after which the concentration drops precipitously until the concentration is too low for effective cleaning. In other words, the detergent is dispensed at a non-uniform and uneconomical rate.

The invention addresses these and many other problems associated with currently available products for the in-machine dispensing of dishwashing detergent.

SUMMARY OF THE INVENTION

The present invention is a dispenser which consists of a container and a removable lid. The container contains a solid detergent composition, and the lid has a plurality of openings to permit water to enter the dispenser. One of the container's side walls has a slot therein for dispensing of the detergent solution produced by dissolution of the solid detergent composition by the water. A baffle is positioned proximate the slot to prevent excess water from entering the container and to allow the detergent solution to freely exit the container. In the preferred embodiment, there are approximately four openings in the lid, each being of approximately 3.0 to 3.5 millimeters in diameter. Preferably, the container is substantially triangular in shape, with the slot being substantially vertical and spanning the height of the hypotenuse side wall. The invention also includes means for removably closing the apertures in the lid and the slot in the side wall.

Another aspect of the invention is a method of washing dishes and utensils in a dishwashing machine. The steps of the inventive method comprise: placing the soiled dishes and utensils in the dishwashing machine; grasping a dispenser of the type described above; removing the cover means from the dispenser's openings and slot; placing the dispenser in the dishwashing machine; closing the dishwashing machine and supplying water which enters the openings in the top portion of the dispenser and forms a detergent solution which flows out of the dispenser; and using the washing solution to come into washing contact with the dishes and utensils so as to clean them.

A particular advantage of the present invention is the ease with which the dispenser is used. The user need only remove an adhesive film which covers the dispenser's openings before placement of the dispenser within the dishwashing machine. After multiple cycles of the dishwashing machine, when the detergent has been completely dissolved, the dispenser can be simply discarded. In this manner, the dispenser serves both as a means for supplying the detergent product which is internal to the dishwashing machine, and a means by which the detergent product is packaged. Besides being simple to use, the dispenser is also relatively low in cost. Further, the controlled dispensing allows the dispenser to be used for a significant number of dishwashing cycles before a new supply of detergent is needed. This long-lasting feature of the invention is an added convenience for the user. Because of the configuration of the dispenser's openings, a proper amount of water is allowed within the dispenser so as to dissolve the most effective amount of detergent product. This results in thorough cleaning of the dishes and utensils, and also prevents over-use of the detergent product, which can result in detergent residues and spotting, as well as unnecessary expense.

Another advantage of the dispenser design is that it allows for the concentration of the detergent solution to be consistent throughout the life of the solid detergent block. That is, the dispenser provides proper control of the detergent concentration both when the dispenser is full and until a point at which the dispenser's contents are substantially consumed.

For a better understanding of the invention, and of the advantages obtained by its use, reference should be made to the drawings and accompanying descriptive matter in which there is illustrated and described a preferred embodiment of the invention.

BRIEF DESCRIPTION OF THE DRAWINGS

In the Drawings which form a part of the instant specification and are to be read therewith, an optimum embodiment of the invention is shown, and, in the various views, like numerals are employed to indicate like parts.

DETAILED DESCRIPTION OF THE INVENTION

Figure 1:
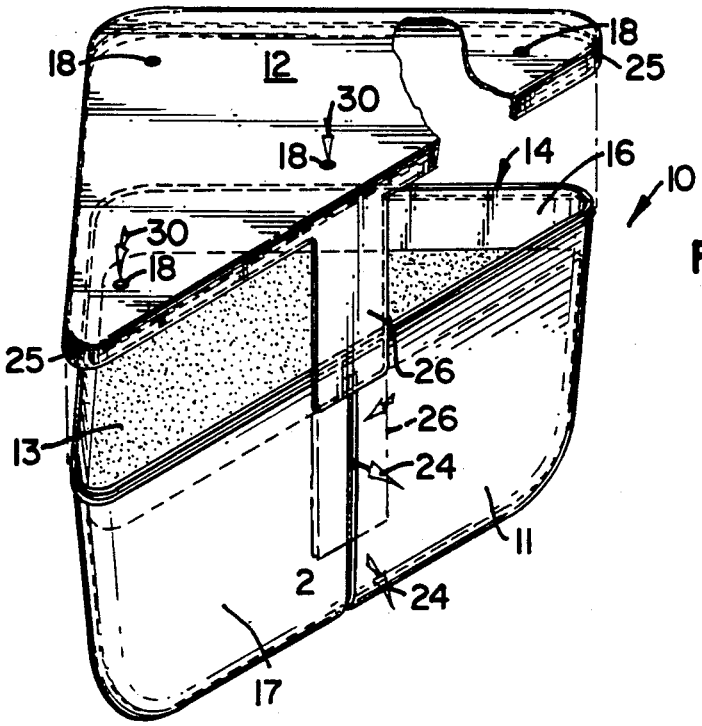
FIG. 1 is a perspective, exploded view of the present invention.
Figure 2:
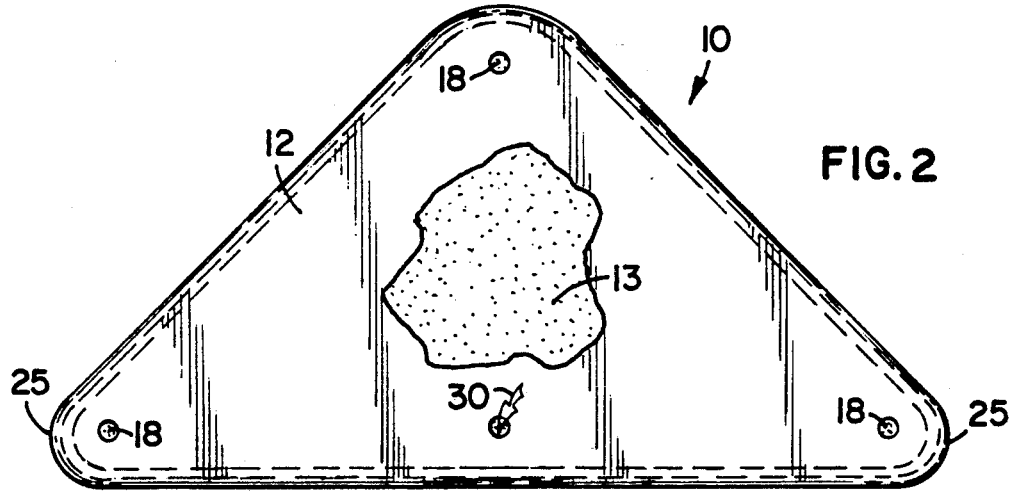
FIG. 2 is a plan view of the dispenser shown in FIG. 1.
Figure 3:
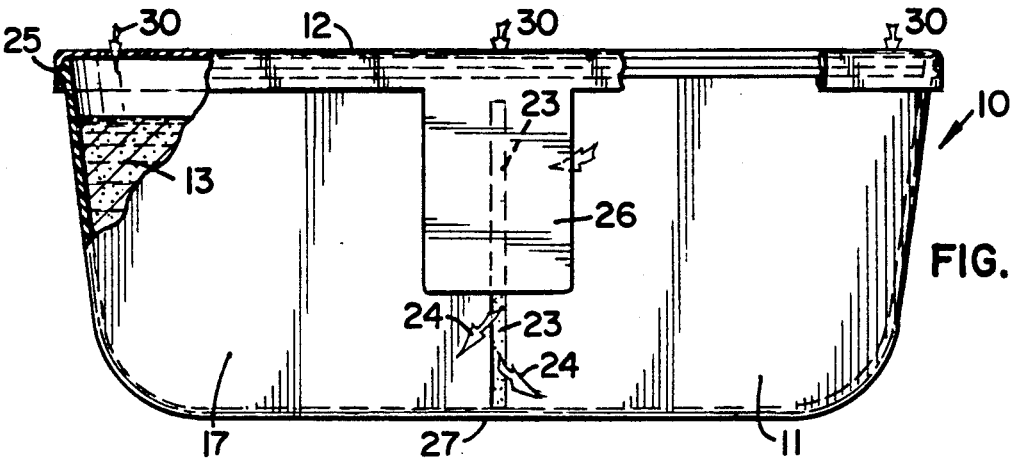
FIG. 3 is a side elevational view of the dispenser illustrated in FIGS. 1-2.

The dispenser 10 of the present invention includes a container 11 and a removable lid 12, which is shown in an exploded configuration in FIG. 1. The container 11 has a solid detergent product 13 therein, or any similar type of product to be dispensed, such as a solid rinse aid. The lid 12 is meant to be removable only for the purpose of filling the container 11 with a detergent product 13 and would thereafter be in sealing engagement with the upper edge 14 of the container 11. Preferably, the peripheral lip 25 of the lid 12 snaps onto the upper edge 14 of the container 11 with a tight fit.

In the preferred embodiment, the container 11 is triangular in shape, having three side walls and a bottom wall 27. Preferably, two of the side walls 15, 16 are isosceles side walls and are of equal length. The remaining side wall 17 is termed the hypotenuse side wall. The use of the term "hypotenuse side wall" is not meant to imply that the triangular shape of the container 11 must include a right angle vertex; it is meant to mean the side wall which is opposite the vertex at which the two isosceles side walls meet.

The lid 11 is provided with a plurality of circular holes 18. The holes are covered by a water resistent film (not shown) having a pressure sensitive adhesive coating which removably adheres the film to at least part of the outer surface of the lid 12 so that the holes 18 are effectively closed. The water resistant film may be either a continuous sheet which covers substantially all of the outer surface of the lid 12, or it may be a plurality of tabs or strips, each of which are positioned to cover one or more holes 18. In the preferred embodiment, the lid 12 has four openings 18, each of which are approximately ⅛ inch or 3 to 3½ mm in diameter. The water enters through the openings 18, as illustrated by the arrows 30. In an alternative embodiment, there may also be holes (not shown) in the bottom wall 27 to ensure the detergent product 13 is completely emptied from the dispenser 10 prior to its disposal.

The hypotenuse side wall 17 has a slot 23 therein which is preferably continuous from the top to the bottom of the dispenser 10 and is substantially vertical. The slot 23 allows water and dissolved detergent product to drain out no matter what level of solid detergent product 13 is present in the dispenser 10. This allows any free-standing water in the dispenser 10 to drain out, thus controlling the dissolving process and helping to prevent the solid product 13 from becoming a slurry. The amount of solid detergent block 13 which dissolves is controlled by the size and number of the apertures 18. In the preferred embodiment, the slot 23 is approximately 1/16 of an inch (1.6 mm) in width. The detergent solution exits from the dispenser 10 through the slot 23, as illustrated by the arrows 24. The slot 23 is covered during the filling and packaging of the dispenser with an adhesive film, and the slot cover (not shown) is removed by the user prior to placing the dispenser 10 in the dishwasher 19.

The dispenser 10 is also provided with a loose covering or baffle 26 which is preferably attached to the lid 12 a its upper end by a suitable adhesive or ultrasonic welding. The baffle 12 is in the form of a planar sheet. The baffle 26 is positioned proximate the slot 23, so as to prevent water from entering the dispenser 10 via the slot 23. In this manner, the baffle 26 serves to improve the concentration control of the dispenser 10. Preferably, the upper end of the baffle 26 is attached to the container's lip 25, so that the baffle 26 hangs a slight distance away from the slot 23. As a result, the baffle 26 does not interfere with the flow of outgoing detergent solution. The baffle 26 is preferably made of a plastic material such as a clear acetate. Two positions of the baffle 26 are illustrated in FIG. 1, the solid lines indicating the baffle's relationship with respect to the lid 12, and the dashed lines indicating the baffle's position when the lid 12 is placed in its operative position upon the container 11.

Before the lid 12 is placed on the container 11, a detergent composition 13 in the form of a solidifiable liquid or slurry is poured into the container. Sufficient liquid detergent is poured into the container 11 until the liquid surface is a short distance below the upper edge 14 of the side walls 15, 16, 17. The lid 12 can be placed on the container 11 before or after the liquid detergent composition solidifies. Alternatively, a powder or granular detergent can be put into the container 11 and compressed therein into a solid block.

Figure 4:
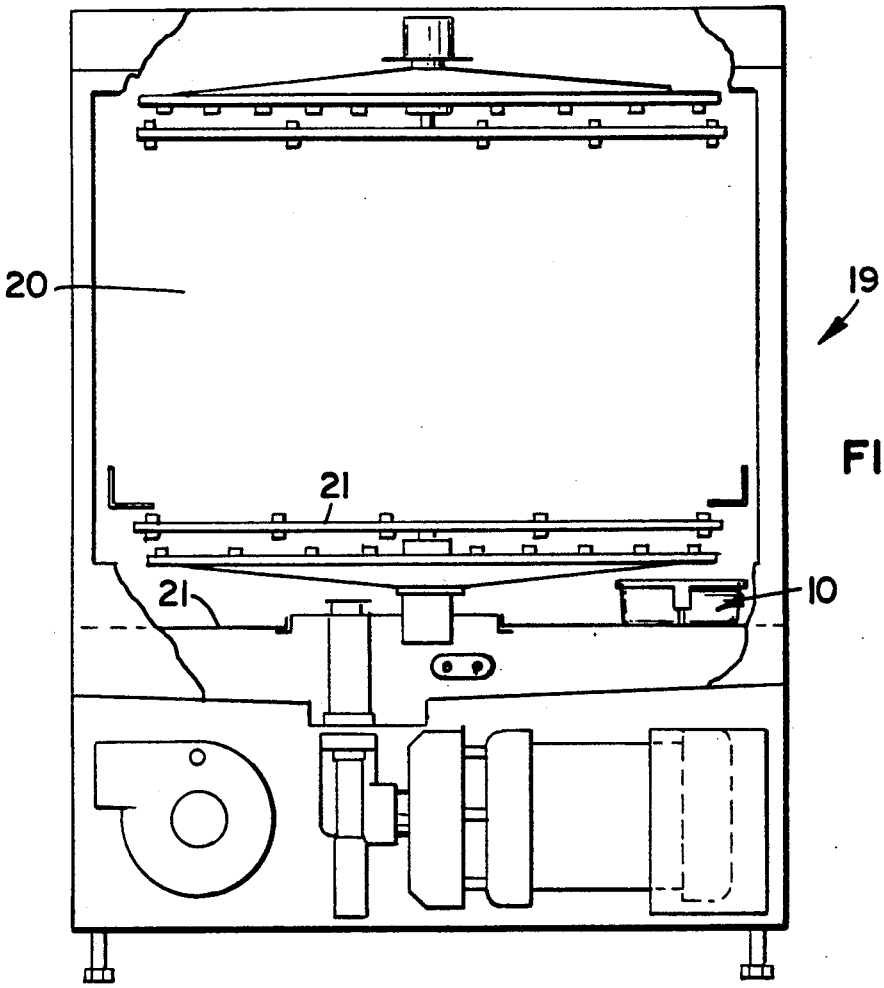
FIG. 4 is a side elevational view of a dishwasher within which is positioned the dispenser of the present invention.
Figure 5:
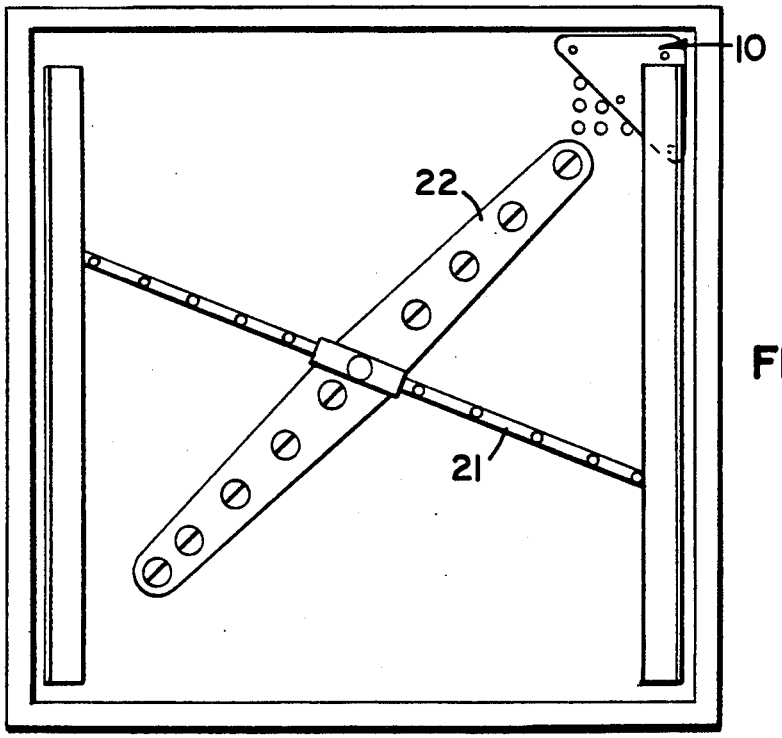
FIG. 5 is a plan view of the dishwasher illustrated in FIG. 4.

The detergent product is used by removing the covering film on the lid 12 and on the side wall 17 and placing the dispenser 10 in the washing chamber 20 of a commercial dishwashing machine 19 (shown in FIGS. 4 and 5). Preferably, the dispenser 10 is placed upon a scrap tray 21 having a foraminous surface. When on the scrap tray 21, the dispenser is below the wash water spray arm 22 and below the rinse water spray arm 21. When the dishwashing machine 19 is activated, some of the wash water sprayed upwardly by wash water arm 22 into the washing chamber 20 descends and flows through the dispenser holes 18 and downwardly through the detergent 13. As the water flows against the detergent surface, it dissolves some of the detergent 13 and forms a detergent solution which flows out of the container through the slot 23. The detergent solution drains out of the dispenser and mixes with water in the chamber 20 to form a washing solution. The washing solution is removed from a collecting well beneath the scrap tray 21 and recirculated to the washing chamber 20 as a spray which cleans the soiled dishes and utensils therein by solubilizing and mechanical impinging action of the washing solution. When the machine is on the rinse cycle, some water will flow through the dispenser 10, but since the rinse cycle is short, little detergent will be used in the rinse step.

The container 11 and lid 12 can be made of an alkali-resistent material which is water-resistant and which can withstand moderately elevated temperatures, e.g. 75° C., and which can be formed into and hold the desired shape. The container 11 and lid 12 are preferably made of a low cost thermoplastic material such as polypropylene which is suitable for disposal after the container 11 has been emptied of the detergent 13 after repeated washing cycles.

The composition of the solid detergent block is not narrowly critical. However, it should not be so hard that it dissolves too slowly or be too soft that it dissolves too rapidly. Suitable solid detergent block compositions are already disclosed in the prior art and they can be used in the subject invention, as see for example U.S. Pat. Nos. 4,595,520; 4,569,781; and 4,690,770. These patents disclose suitable detergent compositions which form cast solid detergent blocks. Detergent blocks weighing from 0.8 to 1.2 kg are generally preferred for ease of handling.

In operation, the user places the soiled dishes and utensils into the washing chamber 20 of the dishwashing machine 19. The user grasps a dispenser 10 and takes off the removable film from the dispenser's lid 12 and side wall 17. The dispenser 10 is then placed within the dishwashing machine, preferably in a corner part of the machine 19, as illustrated in FIGS. 4 and 5, so as to be out of the way of the wash arm and rinse arm and under the dish rack of the dishwasher 19. The hypotenuse side wall 17 thus faces the center of the washing chamber 20. In the preferred embodiment, attachment means (not shown) such as a suitable bracket is utilized to attach the dispenser 10 to the corner of the dishwasher 19.

The dishwashing machine 19 is then closed, and wash water is sprayed, so that water enters the openings 18 in the top portion of the dispenser 10. The water flows downwardly in the dispenser 10 so as to dissolve a portion of the detergent composition 13. The resulting detergent solution flows out of the container 11 through the slot 23 and forms a washing solution which comes into contact with the dishes and utensils to clean them. The solid detergent block 13 is intended to be used for a plurality of dishwashing machine loadings, and the dispenser 10 is left in the dishwashing machine 19 as the detergent block 13 is consumed. The operator need only lift up the container to determine how much of the detergent block 13 remains before initiating another cleaning cycle. If a new block 13 is needed, the user merely discards the container 11 and inserts a new dispenser 10.

In the preferred embodiment, the isosceles side walls 15, 16 are approximately 15 cm in length, and the dispenser 10 is approximately 7 cm in height. The hypotenuse side wall 17 is preferably approximately 20 cm in length.

Based upon the composition of the solid formulation and the size of the dispenser openings, it is preferred that from 7 to 15 grams of solids are dissolved and dispensed per wash load utilizing water at a temperature ranging from about 40°-100° C. This produces a detergent concentration within the desirable range of 0.15-0.35%. A top opening of approximately 0.05 square inches (0.314 $mm^2$) in area will generally provide the desired distribution of product. Using these values, the product should preferably last 60-70 wash cycles (assuming approximately 800 grams of detergent are contained in the dispenser when full), based on its controlled solubility characteristics and its resistance to degradation at elevated drying temperatures.

Some of the characteristics and advantages of the dispenser of the present invention are illustrated in the following Example:

EXAMPLE

Tests were conducted to compare the performance of several designs of dispensers for dishwashing machines. Each dispenser contained an equal mass (600 grams) of detergent product in solid block form. The dispensers compared were: 1) a triangular dispenser (such as the preferred embodiment of the invention) having a slot and baffle; 2) a triangular dispenser having a slot but no baffle; and 3) a cup-like dispenser such as the type disclosed in the Davis patent, U.S. Pat. No. 4,808,236.

The dishwashing machine's tank volume was approximately 18 liters, and the wash and rinse temperatures were approximately 60° C. The wash time was approximately one minute, and the rinse time was approximately eleven seconds. The dispensers were placed in the machine in the rear corner just above the water line and below the wash arm. After each cycle, the concentration of the wash solution was checked via titration.

Figure 6:
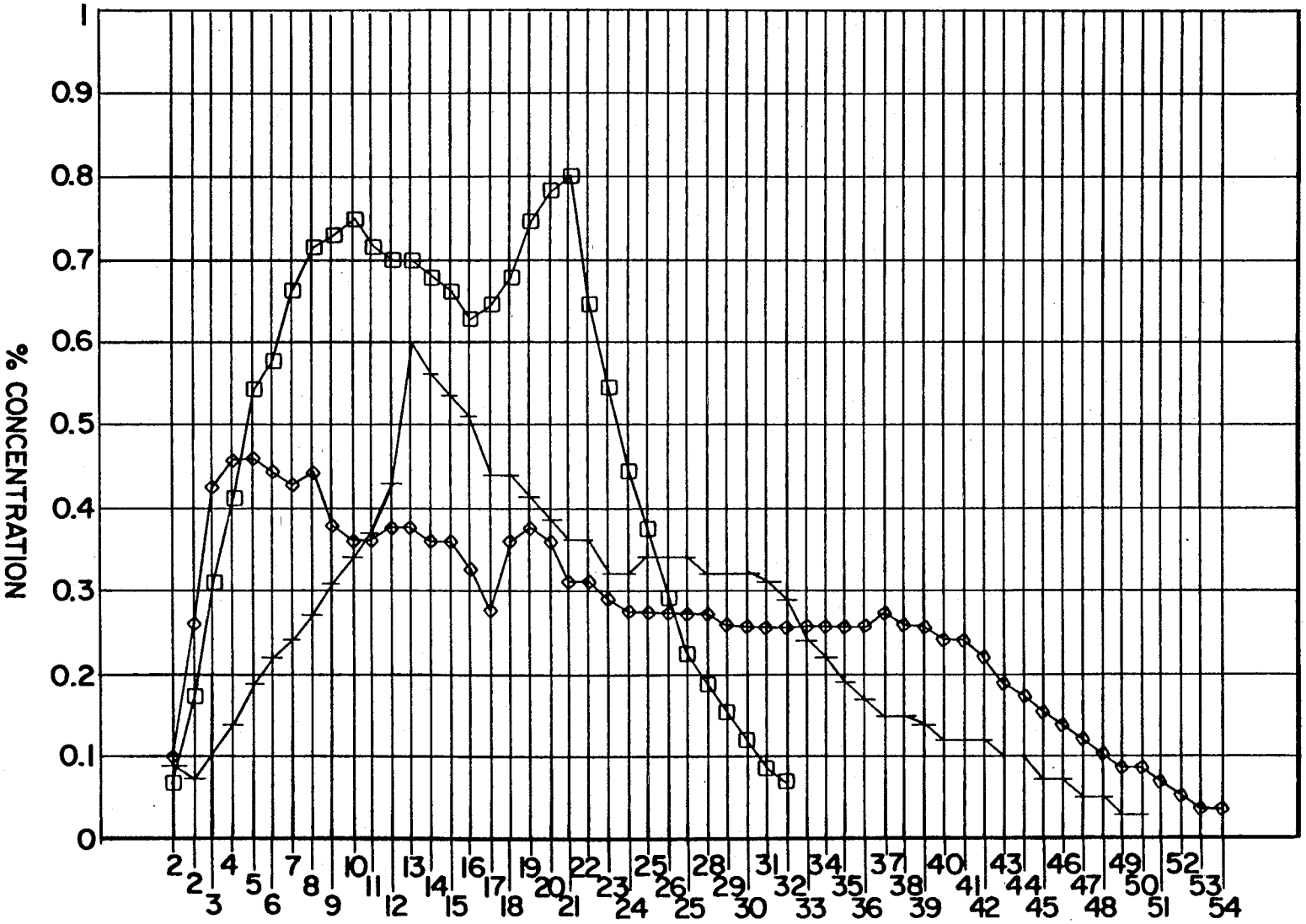
FIG. 6 is a graph which compares the concentration and effective life of three different dishwasher detergent dispenser designs.

The results were plotted as percent concentration in the dishwashing machine's wash tank versus the number of machine cycles. See the graph of FIG. 6. The performance of the dispenser 10 of the present invention with a baffle 26 is shown by the points indicted by the ◊ symbol. The performance of the dispenser 10 without a baffle is indicated by the + symbol. The cup design of the Davis patent is indicated by the ■ symbol.

A concentration of approximately 0.15% is considered the minimum effective concentration for most dishwasher cleaning purposes. The data indicated that detergent dispensed according to the cup design is nearly exhausted after twenty-nine cycles, whereas the slot and baffle design of the present invention continued to provide effective amounts of detergent for forty-six cycles.

The data also showed that the slot and baffle design provided a more uniform and economical use of the detergent. The cup design produced an excessive dispensing concentration (i.e., above 0.35%) for approximately the first 25 cycles.

The slot with no baffle design also produced a more uniform dispensing life as compared to the cup design, and maintained an effective cleaning concentration for approximately thirty-seven cycles.

Even though numerous characteristics and advantages of the invention have been set forth in the foregoing description, together with details of the structure and function of the invention, the disclosure is illustrative only, and changes may be made in detail, especially in matter of shape, size, and arrangement of parts, within the principles of the invention, to the full extent indicated by the broad, general meaning of the appended claims.

What is claimed is:

1. A dispenser for dishwashing machine detergent, comprising:

a) a container having a bottom wall and side walls, one of said side walls having a slot therein for egress of solution, said slot being continuous and elongated and having an upper end and a lower end, said lower end being proximate said bottom wall;

b) a removable lid for a top portion of said container, said lid having a plurality of openings for ingress of solution;

c) means for removably covering the openings in the lid;

d) a solid composition in the container, wherein an upper surface of said composition is below the upper end of said slot, and water dissolves the upper surface of said composition and drains from said slot;

e) a planar sheet which is parallel to one of said side walls and which substantially covers said slot, said sheet being spaced away from said slot.

2. The dispenser according to claim 1, wherein the solid composition is a monolithic solid.

3. The dispenser according to claim 1, wherein said plurality of openings are approximately 3.0 to 3.5 millimeters in diameter.

4. The dispenser according to claim 3, wherein said lid has four spaced-apart openings.

5. The dispenser according to claim 1, wherein the container is substantially triangular in shape and has three side walls, one of which is a hypotenuse side wall.

6. The dispenser according to claim 5, wherein said hypotenuse side wall has a single slot which spans its height.

7. The dispenser according to claim 6, wherein said sheet is interconnected at an upper end to said lid.

8. The dispenser according to claim 4, wherein said container and lid are made of a water resistant material.

9. The dispenser according to claim 1, wherein said means removably covering the openings in said lid are tabs which cover the openings and are adhered to the lid outer surface.

10. A dispenser for dishwashing machine detergent, comprising:

a) a container having a bottom wall, a pair of isosceles side walls, a hypotenuse side wall, and a top portion, said hypotenuse side wall having a single elongate slot therein which substantially spans the height of said hypotenuse side wall and extends proximate said bottom wall, said slot having an upper end and a lower end;

b) a removable lid covering said top portion, said lid having approximately four openings which are approximately 3.0 to 3.5 millimeters in diameter;

c) means for removably covering the openings in said lid;

d) a planar sheet proximate the slot in said hypotenuse side wall, an upper end of said sheet being attached to said lid so as to substantially cover said slot and be spaced away from said slot; and e) a solid composition in the container, a bottom portion of said container being completely filled with said solid composition, wherein an upper surface of said composition is below the upper end of said slot, and water dissolves the upper surface of said composition and drains from said slot.

11. The dispenser according to claim 10, wherein the solid composition is a monolithic solid.

12. The dispenser according to claim 11, wherein said container and lid are made of a water resistant material.

13. The dispenser according to claim 12, wherein said means removably covering the openings are tabs which cover the openings and have adhesive thereon for adhering to the dispenser's outer surface.

* * * * *